United States Patent [19]

Ricchiero

[11] Patent Number: 4,668,418

[45] Date of Patent: May 26, 1987

[54] PHOTOACTIVABLE BLEACHING/DETERGENT COMPOSITION

[75] Inventor: Frederic Ricchiero, Lyons, France

[73] Assignee: Rhone-Poulenc Chimie de Base, Courbevoie, France

[21] Appl. No.: 734,135

[22] Filed: May 15, 1985

[30] Foreign Application Priority Data

May 15, 1984 [FR] France ..... 84 07469
Apr. 4, 1985 [FR] France ..... 85 05124
Apr. 4, 1985 [FR] France ..... 85 05126

[51] Int. Cl.[4] ..... C11D 3/395; C11D 7/54; D06L 3/04

[52] U.S. Cl. ..... 252/95; 8/101; 8/103; 252/94; 252/99; 252/102; 252/186.1; 252/301.26; 252/600

[58] Field of Search ..... 252/95, 99, 102, 186.1, 252/301.26, 600, 94; 8/103, 101

[56] References Cited

U.S. PATENT DOCUMENTS 4,256,598 3/1981 Sakkab ..... 252/99
4,311,605 1/1982 Eckhardt et al. ..... 252/102
4,400,173 8/1983 Beavan ..... 8/107
4,417,994 11/1983 Stoddart ..... 252/135
4,552,562 11/1985 Preiswerk et al. ..... 8/101

FOREIGN PATENT DOCUMENTS 92095 6/1982 Japan .

OTHER PUBLICATIONS

Raju, N. R. K. et al., "Methylene Blue, Rose Bengal and Eosin Sensitized Photooxidation of Diphenylamine", Indian Journal of Chemistry, vol. 12, No. 4 (Apr. 1974), pp. 422–423.

*Primary Examiner*—Prince E. Willis
*Attorney, Agent, or Firm*—Burns, Doane, Swecker & Mathis

[57] ABSTRACT

Detergent compositions adopted for bleaching via photoactivation, e.g., by irradiation with visible light, are comprised of (i) at least one sensitizing agent of xanthene dyestuff type, e.g., a fluorescein, and (ii) at least one cyclic tertiary mono-, di- or tetramine, e.g., DABCO.

22 Claims, No Drawings

PHOTOACTIVABLE BLEACHING/DETERGENT COMPOSITION

BACKGROUND OF THE INVENTION

1. Field of the Invention

The present invention relates to a novel detergent composition, and, more especially, to a novel detergent composition adopted for bleaching by photoactivation. The invention also relates to the use of such composition in detergency applications.

2. Description of the Prior Art

In the course of a washing cycle, the term "bleaching" is typically used to denote the removal of colored spots or stains which are resistant to the action of the alkaline, aqueous wash medium and the detergents which are present in the usual washes. Besides the action of removing coloration, bleaching also includes a disinfecting or antiseptic action in respect of the wash bath.

At the present time, such bleaching is carried out, in particular, by the addition of perborate to the wash liquid. However, in such a situation, the washing operation must be carried out at a temperature of from 80° to 90° C. It is also possible to use sodium hypochlorite when carrying out a cold washing operation. However, such latter substance gives rise to a not inconsiderable amount of fiber damage.

Need has therefore been recognized in this art for a bleaching system which can be used at low temperature, close to ambient temperature, and without damaging the fibers of the textile material being washed.

Such systems have heretofore been proposed, using sensitizing agents, actually being colored organometallic compounds, which act by photoactivation. Thus, French Pat. No. 2,384,882 describes a system which is based on sulfonated aluminum phthalocyanine, as the sensitizing agent. One problem occasioned thereby is that such type of compound remains fixed on the fibers and thus discolors the washed fabric. For that reason, such a system is useless in a practical situation.

SUMMARY OF THE INVENTION

Accordingly, a major object of the present invention is the provision of an improved detergent composition adopted for bleaching by photoactivation, and which is both simple to use and effective with regard to stains, while at the same time minimizing the likelihood of damage to the fibers of the textile substrate being treated. Included therein is a sensitizing agent whose adsorption onto the fibers of the textile under wash is totally reversible upon rinsing.

Briefly, the detergent composition according to the invention features a system for bleaching by photoactivation, and includes (i) at least one sensitizing agent comprising a soluble salt or double salt of an acid having the following general formula:

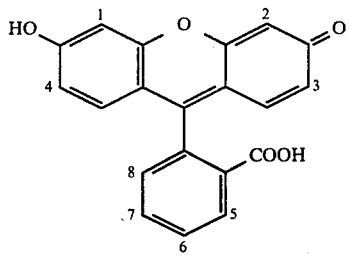

wherein the hydrogen atoms borne by the carbons numbered 1 to 8 either may or may not be substituted, in particular by halogen atoms, and (ii) an additive of the cyclic tertiary mono-, di- or tetramine type.

In addition, the detergent compositions of the invention are useful in bleaching a textile material in accordance with a process which comprises the following steps:

(1) The textile material is contacted with a wash bath comprising the aforesaid composition;

(2) The wash bath and the textile material contained therein are subjected to light irradiation; and (3) The textile material and the wash bath are separated and the textile material is then rinsed with water.

DETAILED DESCRIPTION OF THE INVENTION

More particularly according to the present invention, compounds are employed which belong to the family of xanthene dyestuffs and, more especially, of fluorescein type. As indicated above, such compounds include the water-soluble salts or double salts of the acid having the general formula (1):

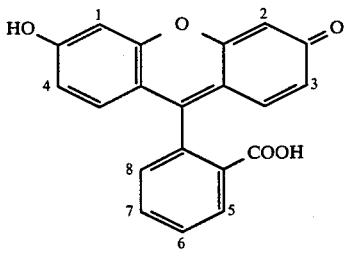

(1)

These salts advantageously are the sodium or potassium salts or double salts. Moreover, the hydrogen atoms borne by the carbons numbered 1 to 8 may be substituted, in particular by the halogens, Cl, Br and I, and all such substitutions are intended hereby as being included in the structural formula (1).

Advantageously, compounds which are particularly suitable for the composition of the invention are those which, other than having the structural formula (1), have the property of being adsorbed reversibly onto the fibers of the substrate undergoing wash. In addition, they have an absorption spectrum which falls substantially in the range of visible light, namely, from 400 to 800 nm, more precisely from 400 to 600 nm.

Among the particularly effective compounds of such type, representative is "Eosin Yellow", namely, the compound having the following structural formula:

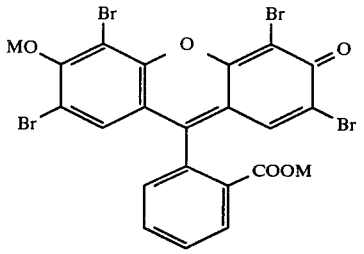

wherein M may be an alkali or alkaline earth metal.

Other exemplary compounds include 1,2-dibromofluorescein, namely, the dibromo salt or double salt of formula (1), 3,4-dibromofluorescein, phloxine, namely, 1,2,3,4-tetrabromo-5,6,7,8-tetrachlorofluorescein, 1,2-diodofluorescein, 3,4-diodofluorescein and 1,2,3,4-tetraiodo-5,6,7,8-tetrachlorofluorescein or "Rose Bengale".

Moreover, it too is advantageous according to the invention to formulate compositions comprising a plurality of sensitizing agents of the above-described type.

By means of such a mixture of sensitizing agents, it is possible to increase the amount of light energy which is absorbed upon irradiation of the wash bath, to thereby enhance the efficiency of the bleaching system. In addition, with such a system, it is possible to reduce the time of irradiation in order to provide a result which is identical to that obtained with a system having a single sensitizing agent.

The combination of Eosin Yellow and Rose Bengale, as well as the combination of Eosin Yellow and 1,2-diodofluorescein, are particularly advantageous consistent with this invention.

Exemplary ternary combinations include (1) 1,2,3,4-tetrachlorofluorescein, (2) Eosin Yellow or 1,2-diodofluorescein, and (3) phloxine or "Rose Bengale".

Moreover, the bleaching system of the invention also comprises an additive which, as hereinbefore mentioned, is selected from among the cyclic tertiary mono, di- or tetramines. Advantageously, the topic system comprises amines of the above-indicated type, but which are also bridged, i.e., amines in which a nitrogen atom is transversely linked or bridged to another nitrogen atom or to a carbon atom in the ring.

An additive which is included in a preferred embodiment of the present invention is 1,4-diaza-(2,2,2)-bicyclooctane (DABCO) having the following structural formula:

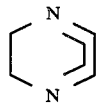

or 1-aza-(2,2,2)-bicyclooctane or quinuclidine (ABCO having the following structural formula:

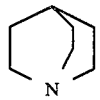

Another preferred additive is hexamethylenetetramine.

The bleaching systems including materials of the type hereinbefore noted may be incorporated in either solid or liquid detergent compositions.

Thus, besides the bleaching system, the detergent composition may comprise a surface active agent. It is preferable that the surface active agent be anionic or, if using a mixture of surface active agents, it is preferable for the mixture to include at least one such anionic agent. Water-soluble salts of alkyl sulfates are exemplary of anionic surface active agents which can be formulated according to the invention.

The composition may also comprise a base or detergent "builder" of known type, such as, for example, phosphates or polyphosphates of alkali metals, which are water-soluble, or silicates.

Finally, the subject composition may also comprise any other known additive, for example, anti-foaming agent, anti-redeposition agent, or perfume.

The proportions of the various constituents of the detergent composition will be selected that, once the composition is dissolved in the wash bath, the concentration of sensitizing agent and in particular eosin ranges from about $10^{-6}$M to $10^{-5}$M. Preferably, that concentration is in the region of 2.5 to $10 \cdot 10^{-6}$M. For higher values, an excessive amount of sensitizing agent may have an internal filter effect which is detrimental to photoactivation upon irradiation of the wash bath.

It will be noted that, when using a mixture of sensitizing agents, the concentration in respect of each sensitizing agent preferably remains within the aforesaid range.

The additive concentration advantageously ranges from $10^{-3}$M to $10^{-1}$M. No effect is found below $10^{-3}$M. No substantial increase in bleaching is found with a value of above $10^{-1}$M. Preferably, the additive concentration is on the order of $10^{-2}$M.

Lastly, the constituents of the detergent composition are preferably selected such that the pH value of the wash bath ranges from 9 to 11.

The compositions of the invention may be used in an extremely simple fashion.

It will first be noted that they are advantageously used for bleaching cotton or mixed textile materials.

The material to be treated is first immersed in a wash bath containing the composition according to the invention. The textile material is maintained in an agitated condition at ambient temperature in the bath and in the dark, or in ambient light, to permit the sensitizing agent to be deposited.

Then, the wash bath and the textile material contained therein are subjected or exposed to irradiation with light in the range of visible light (400–800 nm) which is produced, for example, by a quartz halogen lamp.

The irradiation is advantageously for from 10 to 60 minutes, typically from 10 to 30 minutes. Generally during the irradiation operation, the temperature of the bath is maintained at a value close to ambient temperature.

After irradiation, the bath and the textile material are separated and the material is then rinsed with water for a few minutes in order to remove the sensitizing agent.

It should be noted that it may be advantageous to carry out at least a portion of the rinsing operation, under irradiation. That makes it possible, in particular, to accelerate removal of the sensitizing agent.

In order to further illustrate the present invention and the advantages thereof, the following specific examples are given, it being understood that same are intended only as illustrative and in nowise limitative.

EXAMPLE 1

The starting materials were the following substances:

(1) Crystallized Eosin Yellow extra marketed as R.A.L.;

(2) DABCO;

(3) Sodium dodecylsulfate (SDS); and (4) Detergent builder of the following composition (% by weight):

Na tripolyphosphate: 71

Na pyrophosphate: 5

Anhydrous trisodium phosphate: 1

Silicate in powder form: 23

A wash bath was constituted, comprising 3.1 g/l of builder, SDS: 0.1M, eosin: $0.5 \cdot 10^{-5}$M, and DABCO: $10^{-2}$M, and having a pH of 10.6.

In addition, cotton samples prepared in the following manner were used:

A solution of commercial soluble tea ("NESTEA") in a proportion of 12 g/l in distilled water was heated under reflux (90° C.) for about 1 hour. Three white cotton strips were introduced into the solution and maintained therein for 60 minutes, at a temperature of from 80° to 90° C. The strips were then drained of excess liquid, spread out flat, and dried in ambient air. They were then machine washed in soft water at 30° C. without prewash and then copiously rinsed.

The stained strips were then dried in hot air, ironed between two sheets of filter paper and then cut into testpieces. The testpieces which were of a homogenous coloration were selected and preserved in a condition of being protected from light. Measurements were taken in respect of reflectance of the samples on a Gardner XL-805 reflectometer (standard din 6033) in the trichromatic system $La_Lb_L$.

A sample of stained cotton fabric prepared in the above-indicated manner, of known reflectance, was then introduced into the wash bath and maintained in an agitated condition at ambient temperature and in the dark, to permit the deposition of eosin. The wash bath containing the fabric was then irradiated.

The light irradiation operation was carried out by means of a Hedler projector of "DE LUXE 2000" type, provided with a 1000 w quartz halogen lamp (OSRAM-HALOGEN SUPERPHOT). The distance between the surface of the wash bath and the lamp was about 30 cm.

The irradiation operation was carried out for 60 minutes.

During irradiation, the temperature of the wash bath was maintained on the order of 25° C.

After irradiation, the samples were rinsed for 1 hour in 600 ml of permuted water, in a condition of being protected from light, and then dried between two sheets of filter paper.

Their reflectance was compared with that of the same samples before treatment ($\Delta E_T$) and equivalent samples which were treated under the same conditions and irradiated in the absence of eosin ($\Delta E_{det}$) in order to remove the detergent effect and photodecoloration of the stain.

The bleaching effect obtained by photoactivation $\Delta E_{bl}$ was then:

$$\Delta E_{bl} = \Delta E_T - \Delta E_{det}$$

In the above Example, the following values were determined:

$$\Delta E_T = 18 \text{ and } \Delta E_{bl} = 9$$

EXAMPLE 2

The procedure of Example 1 was repeated, except that a cotton fabric stained with wine (standard EMPA 114 stain) was used.

The irradiation was for 30 minutes.

The following values were determined:

$$\Delta E_T \text{ of } 25 \text{ and } \Delta E_{bl} = 14$$

EXAMPLE 3

The starting materials were the same substances as those used in Example 1, except that the DABCO was replaced by hexamethylenetetramine (HMTA).

A wash bath was constituted, comprising 3.1 g/l of builder, SDS: 0.1M, eosin: $0.8 \cdot 10^{-5}$M, HMTA: $10^{-2}$M, having a pH of 9.8.

The same procedure as that used in Example 1 was followed, on the same samples and with the same stain. However, if the irradiation was for 15 minutes, the following results were obtained:

$$\Delta E_t = 21, \Delta E_{bl} = 11$$

If the irradiation was for 30 minutes, the following results were obtained:

$$\Delta E_T = 15, \Delta E_{bl} = 11.$$

EXAMPLE 4

The procedure of Example 3 was repeated, except a cotton fabric stained with wine (standard EMPA 114 stain) was used.

The irradiation was for 10 minutes.

The following values were determined:

$$\Delta E_T \text{ of } 17 \text{ and } \Delta E_{bl} = 7$$

EXAMPLE 5

The starting materials were as follows:

(1) 1,2,3,4-Tetrachlorofluorescein;

(2) Crystallized Eosin Yellow extra marketed as R.A.L.;

(3) Phloxine;

(4) DABCO;

(5) Sodium dodecylsulfate (SDS); and (6) Builder composition identical to that in Example 1.

A wash bath was constituted, comprising 3.1 g/l of builder, SDS: 0.1M, respective concentration for each sensitizing agent: $10^{-5}$M, and DABCO: $10^{-2}$M.

The samples were prepared, washed and analyzed as described in Example 1. However, the irradiation was for 20 minutes.

The same stain was used ("NESTEA").

The results obtained were as follows:

$$\Delta E_T = 13$$

$$\Delta E_{det} = 3$$

$$\Delta E_{bl} = 10$$

For the same stain, a bleaching effect was obtained which was superior or close to that obtained with a system using a single sensitizing agent (as in the case of Examples 2 or 3), with a shorter irradiation time.

EXAMPLE 6

This Example involves using a number of systems which all comprised the same additive, DABCO, but including different sensitizing agents.

The procedure was the same as in Example 1, on the same stain ("NESTEA"). The sensitizing agent concentration was $10^{-5}$M and the irradiation was for 30 minutes.

The results obtained were as follows:

| Sensitizing agent | $\Delta E_{bl}$ |
|---|---|
| (i) 1,2-Dibromofluorescein | 8 |
| (ii) Phloxine | 8 |
| (iii) 1,2-Diodofluorescein | 10 |

COMPARATIVE EXAMPLE 7

This Example included treating the same fabrics as in the preceding Examples with the same stains in a Linitest apparatus with the same base formulation and the same detergent, replacing the sensitizing agent-additive system by perborate (15% by weight) and TAED (3%).

The washing operation was carried out at a temperature of 60° C. in the course of a 40 minute cycle. The results obtained were as follows:

| | TEA | WINE |
|---|---|---|
| $\Delta ET$ | 16 | 19 |
| $\Delta E_{bl}$ | 11 | 8 |

It thus will be seen that the system according to the invention provides a bleaching effect of the same order of magnitude and even superior to that which is obtained with a perborate system, with a washing time which is shorter in certain cases, for wine in particular, and in all cases at a very much lower temperature.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A composition of matter including (i) at least one sensitizing agent which comprises a soluble salt or double salt of an acid having the formula:

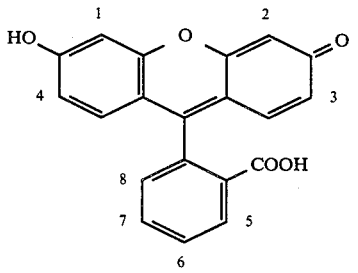

and (ii) at least one cyclic tertiary mono-, di- or tetramine wherein the relative proportion of the constituents of the composition of matter are selected to provide a wash bath concentration of sensitizing agent ranging from about $10^{-6}$M to $10^{-5}$M and a cyclic tertiary amine (ii) concentration of about $10^{-3}$M to $10^{-1}$M.

2. The composition of matter as defined by claim 1, said at least one sensitizing agent (i) having an absorption spectrum within the visible light range.

3. The composition of matter as defined by claim 2, said at least one sensitizing agent (i) comprising a sodium or potassium salt.

4. The composition of matter as defined by claim 2, said acid (i) comprising at least one halogen atom substituent borne by at least one of the carbon atoms numbered 1 to 8.

5. The composition of matter as defined by claim 2, comprising (ii) at least one endocyclic tertiary mono-, di- or tetramine.

6. The composition of matter as defined by claim 5, comprising (ii) 1,4-diaza-(2,2,2)-bicyclooctane.

7. The composition of matter as defined by claim 5, comprising (ii) 1-aza-(2,2,2)-bicyclooctane.

8. The composition of matter as defined by claim 2, comprising (ii) hexamethylenetetramine.

9. The composition of matter as defined by claim 4, said at least one sensitizing agent (i) comprising eosin having the structural formula:

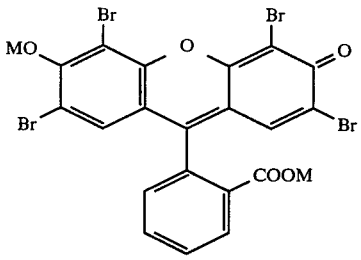

wherein each M is an alkali or alkaline earth metal.

10. The composition of matter as defined by claim 9, said at least one sensitizing agent (i) comprising admixture of eosin and Rose Bengale.

11. The composition of matter as defined by claim 9, said at least one sensitizing agent (i) comprising admixture of eosin and 1,2-diodofluorescein.

12. The composition of matter as defined by claim 2, said at least one sensitizing agent (i) comprising ternary admixture of (1) eosin or 1,2-diodofluorescein, (2) phloxine or Rose Bengale, and (3) 2,2,3,4-tetrachlorofluorescein.

13. A detergent composition comprising the composition of matter as defined by claim 1.

14. The detergent composition as defined by claim 13, further comprising an anionic surface active agent.

15. The detergent composition as defined by claim 14, further comprising a detergent builder.

16. The detergent composition as defined by claim 15, further comprising at least one anti-foaming agent, anti-redeposition agent, or perfume.

17. A wash bath comprising aqueous formulation of the detergent composition as defined by claim 14.

18. A wash bath comprising aqueous formulation of the detergent composition as defined by claim 15.

19. The wash bath as defined by claim 18, having a pH of from about 9 to 11.

20. A method for washing/bleaching a textile substrate, comprising contacting said textile substrate with the wash bath as defined by claim 19, irradiating said wash bath and said textile substrate with light, separating said textile substrate from said wash bath, and rinsing said textile substrate with water.

21. The method as defined by claim 20, wherein said wash bath and said textile substrate are irradiated with visible light for from 10 to 60 minutes.

22. The method as defined by claim 21, at least a portion of said rinsing step being conducted under irradiation.

* * * * *